US010022839B2

(12) United States Patent
Kobayashi et al.

(10) Patent No.: US 10,022,839 B2
(45) Date of Patent: Jul. 17, 2018

(54) SHOT PEENING METHOD

(71) Applicant: Sintokogio, Ltd., Nagoya-shi, Aichi (JP)

(72) Inventors: Yuji Kobayashi, Toyokawa (JP); Akinori Matsui, Toyokawa (JP)

(73) Assignee: SINTOKOGIO, LTD., Nagoya-shi, Aichi (JP)

( * ) Notice: Subject to any disclaimer, the term of this patent is extended or adjusted under 35 U.S.C. 154(b) by 241 days.

(21) Appl. No.: 14/389,841

(22) PCT Filed: Nov. 21, 2012

(86) PCT No.: PCT/JP2012/080195

§ 371 (c)(1),
(2) Date: Oct. 1, 2014

(87) PCT Pub. No.: WO2013/175660

PCT Pub. Date: Nov. 28, 2013

(65) Prior Publication Data

US 2015/0151404 A1 Jun. 4, 2015

(30) Foreign Application Priority Data

May 24, 2012 (JP) ..... 2012-118529

(51) Int. Cl.
*B24C 1/10* (2006.01)
*C21D 7/06* (2006.01)
*B22D 17/22* (2006.01)

(52) U.S. Cl.
CPC ..... *B24C 1/10* (2013.01); *C21D 7/06* (2013.01); *B22D 17/2218* (2013.01); *Y10T 29/479* (2015.01)

(58) Field of Classification Search
CPC ..... B23P 9/00; B22D 17/2218; B24C 1/10; B24C 1/086; C21D 7/06; B21D 31/06;
(Continued)

(56) References Cited

U.S. PATENT DOCUMENTS

2007/0049166 A1 3/2007 Yamaguchi et al.
2012/0180539 A1* 7/2012 Kobayashi ..... B24C 1/086 72/17.3
2012/0231704 A1* 9/2012 Mase ..... B24C 11/00 451/38

FOREIGN PATENT DOCUMENTS

CN 1112045 11/1995
CN 101337339 1/2009
(Continued)

OTHER PUBLICATIONS

Translation of JP 2005207268 A.*
Translation of JPH07290222.*

*Primary Examiner* — Matthew P Travers
(74) *Attorney, Agent, or Firm* — Drinker Biddle & Reath LLP

(57) ABSTRACT

First, it is determined in a determination step by a determination unit whether there is a nitrided layer on a surface of a water-cooled hole of a mold, by using an eddy current sensor. Next, in a shot step, when it is determined in the determination step that there is no nitrided layer, the surface of the water-cooled hole of the mold is shot-peened under a shot condition set according to a base material of the mold, and when it is determined in the determination step that there is the nitrided layer, the surface of the water-cooled hole of the mold is shot-peened under a shot condition which maintains a state where there is the nitrided layer.

7 Claims, 6 Drawing Sheets

(58) Field of Classification Search
CPC ..... Y10T 29/479; Y10T 29/49764; Y10T 29/49771
See application file for complete search history.

(56) References Cited

FOREIGN PATENT DOCUMENTS

| | | | | | |
|---|---|---|---|---|---|
| CN | 101490201 | | | 7/2009 | |
| JP | 7-290222 | A | | 11/1995 | |
| JP | 2002-127015 | A | | 5/2002 | |
| JP | 2003-305647 | A | | 10/2003 | |
| JP | 2005207268 | A | * | 8/2005 | ..... B24C 1/10 |
| JP | 2007-059828 | A | | 3/2007 | |
| JP | 2009-012111 | A | | 1/2009 | |
| JP | 2009-061465 | A | | 3/2009 | |
| JP | 2009-226523 | A | | 10/2009 | |
| JP | 2011-040243 | | | 2/2011 | |
| JP | 4775525 | B2 | | 9/2011 | |
| WO | WO 2010/134232 | | | 11/2010 | |

* cited by examiner

SHOT PEENING METHOD

TECHNICAL FIELD

The present invention relates to a shot processing method.

BACKGROUND ART

In order to apply a compressive residual stress to a surface of a cooling water passage (water-cooled hole), the surface of the cooling passage may be shot-peened (for example, See Patent Literature 1).

CITATION LIST

Patent Literature

Japanese Patent Laid-Open Publication No. H7-290222

SUMMARY OF INVENTION

Technical Problem

However, a method disclosed in Patent Literature 1 has room for improvement in that a compressive residual stress is effectively applied to a surface of a water-cooled hole. Further, in the method disclosed in Patent Literature 1, a tool mark may remain on the surface of the water-cooled hole. A stress may be concentrated on a portion around the tool mark, which may become a reason that a crack is generated.

In the present technical field, a shot processing method, in which the compressive residual stress can be effectively applied to the surface of the water-cooled hole, is required. Further, in the present technical field, a shot processing method, in which a crack is prevented or restrained from being generated on the surface of the water-cooled hole, is required.

Solution to Problem

An aspect of the present invention is to provide a shot processing method including a determination step of determining whether there is a nitrided layer on a surface of a water-cooled hole of a mold; and a shot step of shot-peening the surface of the water-cooled hole under a shot condition set according to a base material of the mold when it is determined in the determination step that there is no nitrided layer, and shot-peening the surface of the water-cooled hole under a shot condition which maintains a state where there is the nitrided layer when it is determined in the determination step that there is the nitrided layer.

In the shot processing method, first, it is determined in the determination step whether there is the nitrided layer on the surface of the water-cooled hole of the mold. Further, in the shot process, when it is determined in the determination step that there is no nitrided layer, the surface of the water-cooled hole of the mold is shot-peened under the shot condition set according to the base material of the mold, and when it is determined in the determination step that there is the nitrided layer, the surface of the water-cooled hole of the mold is shot-peened under the shot condition which maintains a state where there is the nitrided layer. In this way, since the surface of the water-cooled hole of the mold is shot-peened under the shot condition according to whether there is the nitrided layer, a compressive residual stress can be effectively applied to the surface of the water-cooled hole.

In an embodiment, when it is determined in the determination step that there is the nitrided layer, the shot peening step is applied to a degree less than or equal to half of what would be required to remove the nitride layer, and the determination step and the shot step may be alternately performed several times. By configuring the shot processing method in this way, a situation can be prevented in which the nitrided layer is removed by the excessive shot-peening process.

In an embodiment, the determination step also determines whether there is a compound layer constituting a surface side as a part of the nitrided layer and whether there is a diffusion layer constituting a base material side as a part of the nitrided layer. When it is determined in an initial determination step that there is the compound layer and there is the diffusion layer, the determination step and the shot step may be alternately performed at least until there is no compound layer and there is the diffusion layer. By configuring the shot processing method in this way, when it is determined in the determination step that there is the nitrided layer, the shot-peening is effectively performed while there is the nitrided layer.

In an embodiment, the determination step may determine whether there is the nitrided layer on the surface of the water-cooled layer, by using an eddy current sensor inserted into the water-cooled hole. By configuring the shot processing method in this way, the determination can be simply performed.

In an embodiment, the determination step may determine whether there is the compound layer constituting a surface side as a part of the nitrided layer and whether there is the diffusion layer constituting a base material side as a part of the nitrided layer, by using an eddy current sensor inserted into the water-cooled hole. By configuring the shot processing method in this way, the determination can be simply performed.

In an embodiment, the shot step may shot-peen the surface of the water-cooled hole by injecting compressive air and the projection material from a nozzle for the shot-peening, inserted into the water-cooled hole. By configuring the shot processing method in this way, even when the water-cooled hole has a small diameter and is deep, it is possible to make the projection material with a high speed be in contact with a bottom portion. Thus, a compressive residual stress can be effectively applied to the bottom portion of the water-cooled hole.

Another aspect of the present invention is to provide a shot processing method including a determination step of determining whether there is a tool mark on a surface of a water-cooled hole of a mold; and a shot step of shot-peening a surface of the water-cooled hole under a shot condition which removes the tool mark from the surface of the water-cooled hole when it is determined in the determination step that there is the tool mark.

In the shot processing method, first, it is determined in the determination step whether there is the nitrided layer on the surface of the water-cooled hole of the mold. Next, in the shot step, when it is determined in the determination step that there is the tool mark, the surface of the water-cooled hole of the mold is shot-processed under a shot condition which removes the tool mark from the surface of the water-cooled hole of the mold. In this way, according to whether there is the tool mark, the shot condition can be changed, and the tool mark can be removed from the surface of the water-cooled hole of the mold. Therefore, it is possible to avoid stress concentration at a portion around the tool mark. Thus, a crack can be prevented or restrained from being generated.

In an embodiment, the determination step may determine whether there is the tool mark on the surface of the water-cooled layer, by using an eddy current sensor inserted into the water-cooled hole. By configuring the shot processing method in this way, the determination can be simply performed.

Advantageous Effects of Invention

As described above, according to an aspect and an embodiment of the present invention, a compressive residual stress can be effectively applied to a surface of a water-cooled hole. Further, according to another aspect and another embodiment of the present invention, a crack can be prevented or restrained from being generated on the surface of the water-cooled hole.

BRIEF DESCRIPTION OF DRAWINGS

FIG. 3A illustrates a determination step, and FIG. 3B illustrates a shot step;

FIG. 6A illustrates a determination step, and FIG. 6B illustrates a shot step.

DESCRIPTION OF EMBODIMENTS

First Embodiment

A shot processing method according to a first embodiment will be described with reference to FIGS. 1 to 4.

(A Shot Processing Apparatus and Mold)

Figure 1:
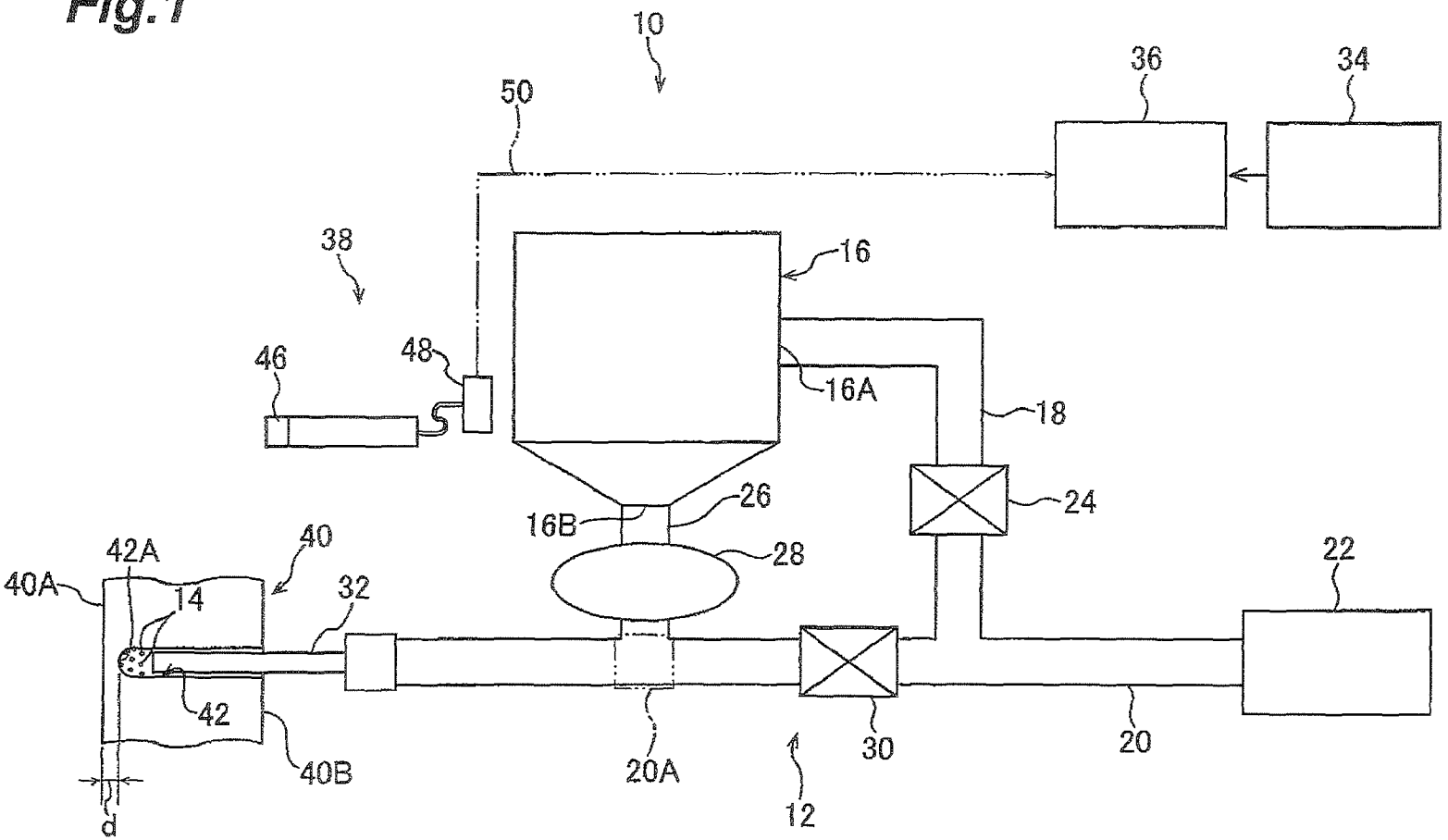
FIG. 1 is a schematic view illustrating a shot processing apparatus, which is applied to a shot processing method, according to a first embodiment.

FIG. 1 is a schematic diagram illustrating a shot processing apparatus 10, which is applied to a shot processing method, according to the present embodiment. First, the shot processing apparatus 10, and a mold 40 which is a target to be shot-processed will be described.

As illustrated in FIG. 1, the shot processing apparatus includes a projection unit 12. The projection unit 12 has an object to inject (project) a projection material 14 to a subject to be processed (in the present embodiment, the mold 40), and includes a tank 16 for supplying the projection material 14. Meanwhile, in the present embodiment, a metal ball is employed as the projection material 14 (referred to as a shot or a shot material), and a Vickers hardness of the projection material 14 is equal to or larger than the subject to be processed.

An airflow inlet 16A is formed at an upper portion of the tank 16, and an end portion of a connection pipe 18 is connected to the airflow inlet 16A. The other end portion of the connection pipe 18 is connected to a central portion of a channel of a connection pipe 20, and an end at an upstream side (right side in the drawing) of the channel of the connection pipe 20 is connected to a compressor (compressive air supplying apparatus) 22 for supplying compressive air. That is, the tank 16 is connected to the compressor 22 through the connection pipes 18 and 20. Further, an airflow control valve 24 (electro-pneumatic proportional valve) is installed at a central portion of a channel of the connection pipe 18, and compressive air from the compressor 22 is supplied into the tank 16 as the airflow control valve 24 is opened. Accordingly, the interior of the tank 16 can be pressurized.

Further, a shot outlet 16B in which a cut gate (not illustrated) is installed is formed at a lower portion of the tank 16, and an end portion of a connection pipe 26 is connected to the shot outlet 16B. The other end portion of the connection pipe 26 is connected to a central portion of the channel of the connection pipe 20, and a shot flow control valve 28 is installed at a central portion of a channel of the connection pipe 26. For example, a magna valve, a mixing valve, etc. is applied as the shot flow control valve 28. A confluence portion between the connection pipe 20 and the connection pipe 26 is formed as a mixing portion 20A. In the connection pipe 20, an airflow control valve 30 (electro-pneumatic proportional valve) is installed between an upper stream side (right side in the drawing) of the mixing portion 20A and a lower stream side (left side in the drawing) of a connection portion between the connection pipe 18 and the connection pipe 20.

That is, in a state where the interior of the tank 16 is pressurized, when the cut gate and the shot flow control valve 28 are opened and the airflow control valve 30 is opened, the projection material 14 supplied from the tank 16 and the compressive air supplied from the compressor 22 are mixed in the mixing portion 20A to flow toward a downstream side of the channel of the connection pipe 20 (toward a left side in the drawing).

A nozzle 32 for spraying (shot-peening) is connected to an end portion at the downstream side of the channel of the connection pipe 20. Accordingly, the projection material 14 having flown to the mixing portion 20A is forced to be injected from a distal end of the nozzle 32 in a state of being mixed with the compressive air. The nozzle 32 has a cylindrical shape, and has a diameter by which the nozzle 32 can be inserted into the water-cooled hole 42 of the mold 40.

Further, the shot processing apparatus 10 may have a configuration in which a robot arm (not illustrated) for clamping the nozzle 32 is included, or may have a configuration in which the robot arm moves the nozzle 32 forwardly/backwardly (reciprocates the nozzle 32) with respect to the water-cooled hole 42.

The shot processing apparatus 10 includes a manipulation unit 34. The manipulation unit 34 is configured to be able to input a process condition (a part of a shot condition including, e.g., pressure of the compressive air supplied from the compressor 22 and an amount of the projection materials 14 injected from the nozzle 32) when performing the shot peening process, and is configured to output a signal according to the input manipulation, to a control unit 36. The control unit 36 is configured to have, for example, a memory device, a calculation processing device, etc., and is configured to control the compressor 22, the airflow control valves 24 and 30, the shot flow control valve 28, the aforementioned cut gate (not illustrated), etc., based on the signal output from the manipulation unit 34. That is, a program, for performing the shot peening process under a shot condition according to a signal output from the manipulation unit 34, is previously stored in the control unit 36.

Meanwhile, in the mold 40, a design surface 40A constituting a matching surface side is formed to have a shape for forming. In contrast, a plurality of water-cooled holes 42 (not illustrated) having a small diameter and a bottom are formed on a rear surface 40B of the mold 40 (surface opposite to the design surface 40A).

The mold 40 in the present embodiment is formed by mold for die cast, which is made of an alloy material after a nitriding process (in the present embodiment, as an example, a soft nitrided material of SKD61). Further, the die cast is one of metal mold casting methods, and is a casting method which can produce a casting having high dimensional accuracy with a short time by a large amount, by forcibly inserting melted metals into the mold 40. At a time of pressing molten metal into the mold 40, such a mold 40 is exposed to high temperature, and at a time of water-cooling using the water-cooled hole 42, such a mold 40 is cooled. Further, a distance d between a bottom portion 42A of the water-cooled hole 42 and the design surface 40A is configured to be short in order to promptly cool the mold 40.

Further, the nitriding process implemented in the mold 40 refers to a heat process of obtaining a very hard nitrided layer on the surface of the mold 40, by heating an alloyed steel containing one or more of, for example, Al, Cr, Mo, Ti and V, in $NH_3$ gas, at low temperature around 500° C. The nitrided layer basically includes a diffusion layer constituting an alloyed steel side of a base material, and a compound layer constituting a surface side of the base material. The diffusion layer corresponds to a layer in which nitrogen is diffused in the alloyed steel. Further, the compound layer corresponds to a layer of which the main material is nitride, carbide, nitrocabride, etc., and is very hard and brittle characteristic. Meanwhile, from the beginning time, the nitrided layer may exist as a normal layer which is formed only for the diffusion layer. Here, the "normal layer" in the present embodiment corresponds to a layer formed to have a thickness by which a layer can be recognized to be in a normal layer state.

In contrast, the shot processing apparatus 10 includes a determination unit 38 for determining whether there is a nitrided layer or not. Further, although the determination unit 38 in the present embodiment is installed as a part of the shot processing apparatus 10, the determination unit 38 may installed separately with respect to the shot processing apparatus 10.

The determination unit 38 includes an eddy current sensor 46 and a determination unit 48 connected to the eddy current sensor 46. The eddy current sensor 46 outputs, to the determination unit 48, an estimation signal according to whether there is the nitride layer, whether there is the compound layer, and whether there is the diffusion layer, on a surface (inner surface) of the water-cooled hole 42 of the mold 40. The determination unit 48 determines whether there is the nitrided layer, whether there is the compound layer, and whether there is the diffusion layer, based on the estimation signal received from the eddy current sensor 46, and is configured by an electric circuit having, for example, a Central Processing Unit (CPU), etc.

Further, the determination unit 48 may be configured to be connected to the control unit 36 (See a two-dot chain line 50 in the drawing) to output the determination result of the determination unit 48 to the control unit 36. Further, the determination unit 48 is configured to be able to manipulate the aforementioned robot arm, and the robot arm manipulated by the determination unit 48 may install the eddy current sensor 46.

(A Shot Processing Method)

Figure 2:
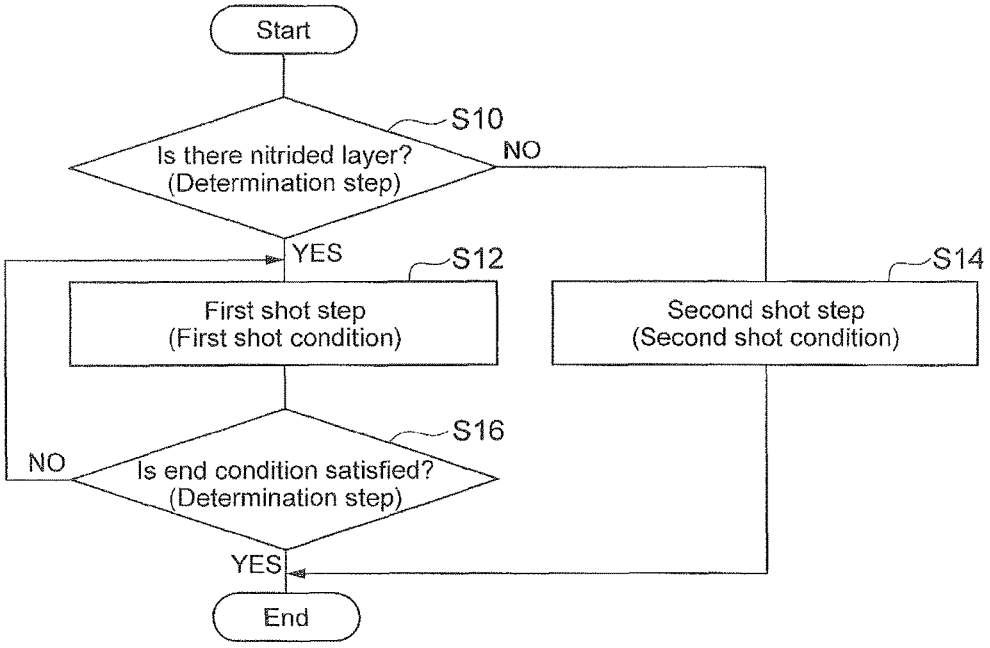
FIG. 2 is a flowchart illustrating a shot-peening processing method according to a first embodiment.
Figure 3A:
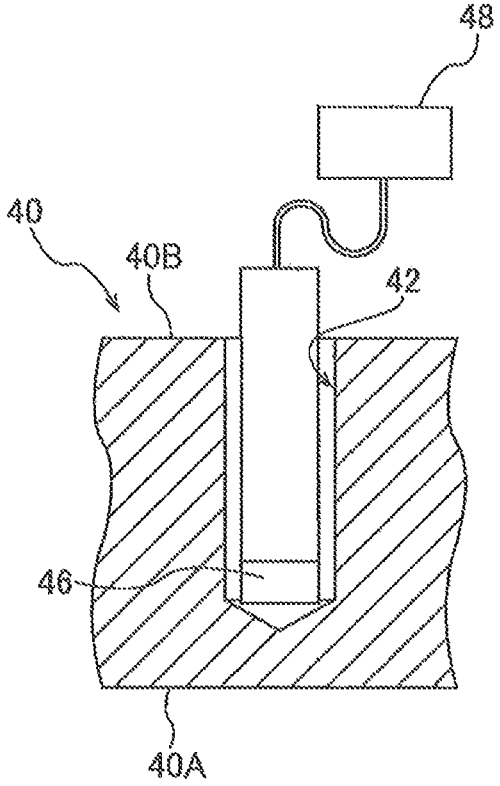
FIGS. 3A and 3B are sectional views for describing the shot processing method according to a first embodiment.
Figure 3B:
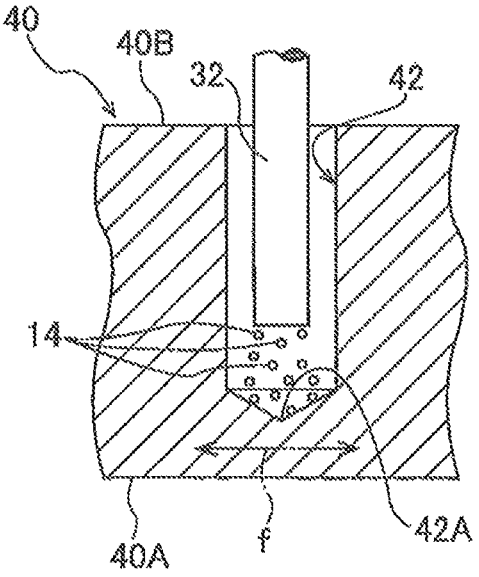

Next, while describing the shot processing method, an operation and an effect of the shot processing method will be described. FIG. 2 is a flowchart illustrating a shot processing method according to a first embodiment. FIGS. 3A and 3B are sectional views for describing the shot processing method according to the present embodiment.

As illustrated in FIG. 2, first, the determination unit 48 performs a determination step of a sensor estimation signal (S10). In the step of S10, as illustrated in FIG. 3A, for example, the robot atm inserts the eddy current sensor 46 into the water-cooled hole 42. Next, the determination unit 48 determines whether there is the nitrided layer on a surface (inner surface) of the water-cooled hole 42 of the mold 40 (in a wide meaning, by a nondestructive inspection using an electromagnetic scheme) (determination step). Further, in the present embodiment, the determination unit 48 determines whether there is the compound layer constituting the surface side as a part of the nitrided layer and whether there is the diffusion layer constituting the base material side as a part of the nitrided layer, by using the eddy current sensor 46.

Further, in the present embodiment, whether there is the nitrided layer corresponds to whether there is a nitrided layer constituting the normal layer. When there is the nitrided layer constituting the normal layer, it is determined that there is the nitrided layer, or else it is determined that there is no nitrided layer. Further, in the present embodiment, whether there is the compound layer corresponds to whether there is a compound layer constituting the normal layer. When there is the compound layer constituting the normal layer, it is determined that there is the compound layer, or else it is determined that there is no compound layer. Further, in the present embodiment, whether there is the diffusion layer corresponds to whether there is a diffusion layer constituting the normal layer. When there is the diffusion layer constituting the normal layer, it is determined that there is the diffusion layer, or else it is determined that there is no diffusion layer.

A well-known eddy current sensor is applied to the eddy current sensor 46. In simply describing the eddy current sensor 46, the eddy current sensor 46 includes a coil (not illustrated) within a sensor head, and generates a high frequency magnetic field by allowing a high frequency current to flow through the coil. Further, when there is a conductor (the mold 40) within the high frequency magnetic field generated by the eddy current sensor 46, a change in the magnetic field is induced, so that an eddy current having a spiral shape is generated in the conductor (the mold 40). An impedance of the coil of the eddy current sensor 46 is changed by a magnetic flux accompanied in the eddy current. Meanwhile, a passage of the eddy current and a passage of the magnetic flux are changed by a chemical composition, a crystal structure, etc. of the conductor (the mold 40) which is a target to be determined, so that an impedance of the coil of the eddy current sensor 46 is changed.

The eddy current sensor 46 uses such a phenomenon, and outputs, to the determination unit 48, different estimation signals according to whether there is the nitrided layer, whether there is the compound layer, and whether there is the diffusion layer. The determination unit 48 determines whether there is the nitrided layer (whether there is the compound layer and whether there is the diffusion layer), based on the estimation signal received from the eddy current sensor 46. In this way, whether there is the nitrided layer (whether there is the compound layer and whether there is the diffusion layer) can be simply determined by using the eddy current sensor 46.

Next, for example, the robot arm pulls out the eddy current sensor 46, and withdraws the eddy current sensor 46 to the outside of the water-cooled hole 42. Thereafter, for example, the robot arm inserts the nozzle 32 illustrated in FIG. 3B into the water-cooled hole 42. Next, the control unit 36 injects the compressive air and the projection material from the distal end of the nozzle 32 toward the bottom portion 42A of the water-cooled hole 42, based on the determination result (S12 and S14). Here, when it is determined in the determination step of S10 that there is no nitrided layer, the control unit 36 shot-peens the surface of the water-cooled hole 42 of the mold 40 under a second shot condition set according to the base material of the mold 40 (S14: second shot process). Meanwhile, when it is determined in the determination step of S10 that there is the nitrided layer, the control unit 36 shot-peens the surface of the water-cooled hole 42 of the mold 40 under a first shot condition which maintains a state where there is the nitrided layer (S12: first shot process). Further, the second shot condition set according to the base material of the mold 40 implies an optimal processing condition obtained by considering a mechanical property of the base material (optimal condition for obtaining the compressive residual stress which is required).

In this way, the compressive residual stress is effectively applied to the surface of the water-cooled hole 42 by shot-peening the surface of the water-cooled hole 42 of the mold 40 under the shot condition according to whether there is the nitrided layer.

Further, when it is determined in the determination step of S10 that there is the nitrided layer, in the first shot step of S12, the control unit 36 applies, as the shot peening process, one time, the compressive residual stress to the surface of the water-cooled hole 42 of the mold 40. The control unit 36 performs the shot peening process to a degree less than or equal to half of what would be required to remove the nitride layer. Accordingly, a situation where the nitrided layer is removed (excessively cut) by an excessive shot-peening process is prevented.

Further, in the shot steps of S12 and S14, for example, as the robot arm moves the nozzle 32 along the water-cooled hole 42, portions other than the bottom portion 42A of the water-cooled hole 42 is shot-peened. After the shot steps of S12 and S14, for example, the robot arm pulls out the nozzle 32, and withdraws the nozzle 32 to the outside of the water-cooled hole 42.

Here, when it is determined in the initial determination step (S10) that there is the compound layer and there is the diffusion layer, the determination unit 48 and the control unit 36 alternately perform the determination step of S16 and the first shot step of S12 until it is determined in the determination step (S16) after the determination of at least next time shows a determination result that there is no compound layer and there is the diffusion layer. That is, a termination condition of the repeated process corresponds to a case where it is determined in the determination step after the next time that there is no compound layer and there is the diffusion layer. Each of the determination step of S16 and the first shot step of S12 performs several times until the termination condition is satisfied. Accordingly, when it is determined in the determination step of S10 that there is the nitrided layer, the shot-peening process is effectively preformed while maintaining a state where there is the nitrided layer.

As described above, in accordance with the shot processing method according to the present embodiment, the compressive residual stress can be effectively applied to the surface of the water-cooled hole 42. As a result, a Stress Corrosion Cracking (SCC) around the water-cooled hole 42 of the mold 40 is prevented or is effectively restrained.

Here, the stress corrosion cracking will be described complementally. At the time of pressing molten metal into the mold 40, the design surface 40A of the mold 40 is exposed to high temperature, and at the time of the water cooling in which cooling water is introduced into the water-cooled hole 42, the mold 40 is cooled. When such a cycle is continuously repeated, it is likely that a heat check or a heat crack is generated and the mold is destroyed. Meanwhile, in recent years, in order to achieve a time shortening for one cycle when a die cast product is manufactured (in addition, in order to reduce manufacturing costs), or in order to cope with an increase in a size of the die cast product, the mold is needed to be rapidly cooled. Accordingly, an action is performed in which the number of the water-cooled holes 42 formed in the mold 40 is increased, or the water-cooled hole 42 and the design surface 40A become close to each other. However, when the water-cooled hole 42 and the design surface 40A become close to each other, a thermal gradient (thermal stress gradient) becomes difficult, so that a thermal stress (tensile stress f) increases so as to increase a possibility to generate the stress corrosion cracking.

There are three factors contributing to generation of the stress corrosion cracking, which are generally a material factor, an environment factor, and the tensile stress f, and when all of the three conditions are satisfied, the stress corrosion cracking is generated. Accordingly, in the present embodiment, a compressive residual stress is applied by shot-peening, so that an effect of the tensile factor f which is one of the factors of the generation of the stress corrosion cracking is restrained, and in addition, the generation of the stress corrosion cracking is restrained.

However, when the water-cooled hole 42 (thin deep hole) which has a small diameter and is a deep blind hole is shot-peened, deflation of the compressive air injected from the nozzle 32 to the interior of the water-cooled hole 42 is bad. Further, when a speed of the projection material 14 mixed with the compressive air does not reach a needed speed due to the had deflation, an effect of the shot-peening process may not be obtained at the bottom portion 42A (terminal portion) of the water-cooled hole 42. Accordingly, in the present embodiment, since the surface of the water-cooled hole 42 is shot-peened by injecting the projection material 14 together with the compressive air from the nozzle 32 inserted into the water-cooled hole 42, even when the water-cooled hole 42 is a blind hole, has a small diameter, and is deep, the projection material 14 having a high speed can be in contact with the bottom portion 42A of the water-cooled hole 42. Thus, the compressive residual stress is effectively applied to the bottom portion 42A of the water-cooled hole 42.

Figure 4:
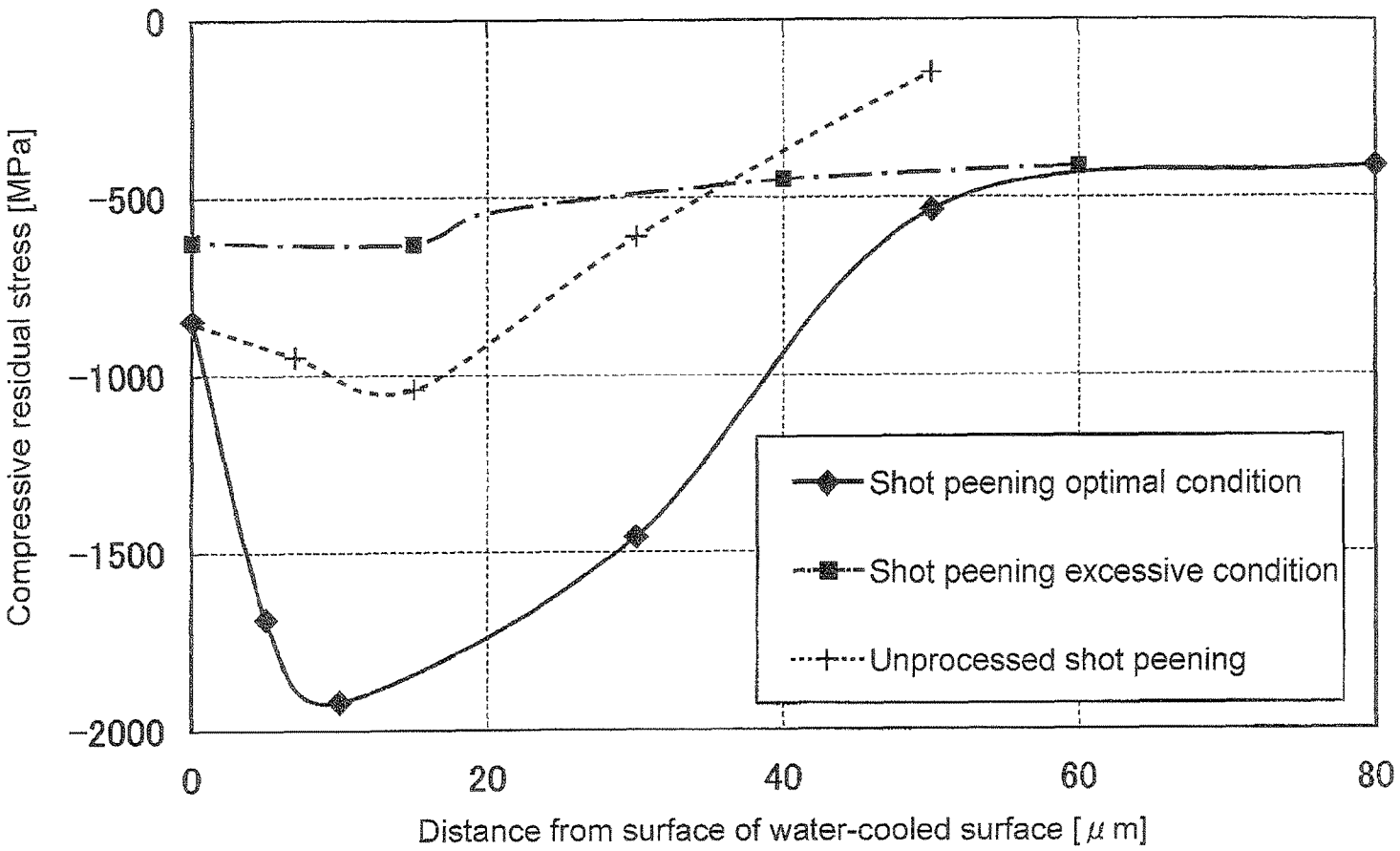
FIG. 4 is a graph depicting a distribution of a compressive residual stress for each case of an optimal shot peening process, an excessive shot peeing process, and unprocessed shot peening.

Meanwhile, the compressive residual stress may not be effectively applied according to whether there is the nitrided layer on the inner surface of the water-cooled hole 42. Here, FIG. 4 illustrates a result obtained by measuring a distribution of the compressive residual stress for each case of the optimal shot peening process, the excessive shot peening process and the unprocessed shot peening. A horizontal axis denotes a distance from the surface of the water-cooled hole 42 (vertical directional depth at the base material of the mold 40 with respect to the surface). When a portion being in a state in which there is the nitrided layer before the shot peening process is performed becomes a state in which there is no nitrided layer after the excessive shot peening process is performed, the compressive residual stress cannot be effectively applied to a target portion. In this regard, in the present embodiment, since the surface of the water-cooled hole 42 of the mold 40 is shot-peened under an optimal shot condition (process condition) according to whether there is the nitrided layer on the surface of the water-cooled hole 42 illustrated in FIGS. 3A and 3B, the compressive residual stress is effectively applied to the surface of the water-cooled hole 42.

Further, in the present embodiment, a rehearsal determination step, which determines whether there is the nitrided layer on the rear surface 40B of the mold 40 before the determination step illustrated in FIG. 3A, may be performed, and a rehearsal shot step, which shot-peens the rear surface 40B of the mold 40 after the rehearsal determination step and before the determination step, may be performed. Further, when it is determined in an initial rehearsal determination step that there is the nitrided layer, the rehearsal determination step and the rehearsal shot step are alternately performed until it is determined in the rehearsal determination step that there is no nitrided layer, and the first shot condition in a case where it is determined in the determination step of S10 based on the shot condition in the meanwhile that there is the nitrided layer is configured. That is, the first shot condition, which becomes a limitation by which a state where there is the nitrided layer in the water-cooled hole 42 can be maintained, is anticipated by alternately performing the rehearsal determination step and the rehearsal shot step.

Second Embodiment

Figure 5:
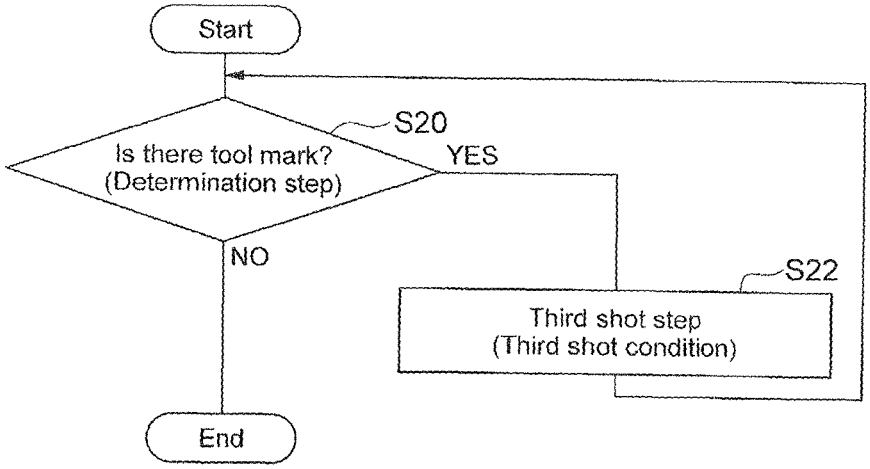
FIG. 5 is a flowchart illustrating a shot-peening process method according to a second embodiment.
Figure 6A:
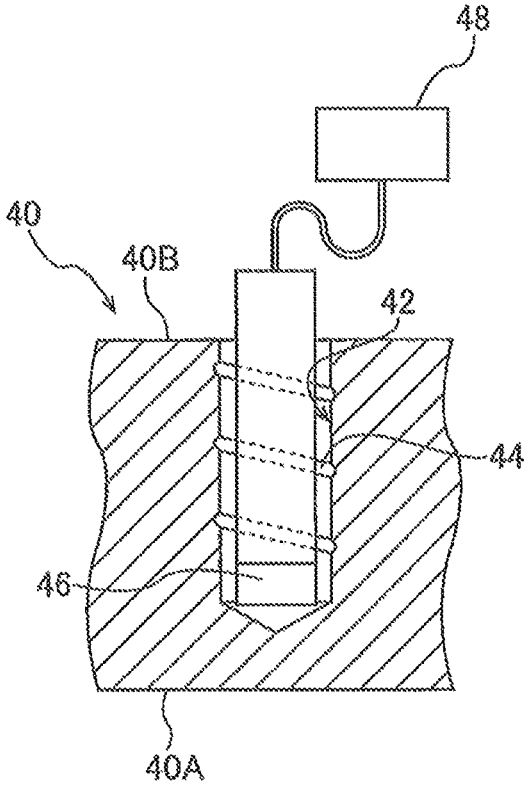
FIGS. 6A and 6B are sectional views for describing the shot processing method according to a second embodiment.
Figure 6B:
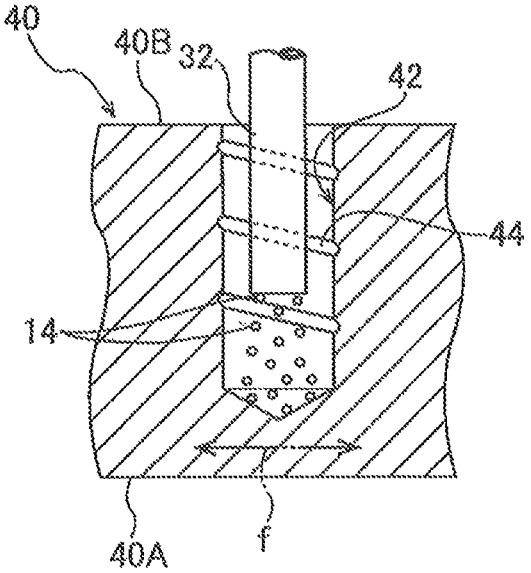

Next, a shot processing method according to a second embodiment will be described with respect to FIGS. 5 and 6. FIG. 5 is a flowchart illustrating the shot processing method according to the second embodiment. FIGS. 6A and 6B is sectional views for describing the shot processing method according to the second embodiment. Further, a basic configuration of a shot processing apparatus, applied to the shot processing method, has the same as that of the first embodiment. Thus, the same component as that of the first embodiment is designated by the same reference numeral, and a description thereof will be omitted.

As illustrated in FIG. 5, first, the determination unit 48 performs a determination step of a sensor measurement signal (S20). In the step of S20, as illustrated in FIG. 6A, for example, the robot arm inserts the eddy current sensor 46 into the water-cooled hole 42. Next, the determination unit 48 determines whether there is a tool mark 44 on the surface (inner surface) of the water-cooled hole 42 of the mold 40, by using the eddy current sensor 46 (in a wide meaning, by a nondestructive inspection using an electromagnetic scheme).

To supplement, although an eddy current is generated on the surface of the water-cooled hole 42 of the mold 40 by a high frequency magnetic field generated by the eddy current sensor 46, according to the cases where there is the tool mark 44 and there is no tool mark 44, a passage of the eddy current is changed, so that a passage of the magnetic flux accompanied in the eddy current is changed. As a result, since the impedance of the coil of the eddy current sensor 46 is changed, the eddy current sensor 46 outputs an estimation signal according to whether there is the tool mark 44, to the determination unit 48. The determination unit 48 determines whether there is the tool mark 44 based on the estimation signal received from the eddy current sensor 46. In this way, it can be simply determined whether there is the tool mark 44, by using the eddy current sensor 46.

Meanwhile, the tool mark 44 (unevenness) on the surface of the water-cooled hole 42 corresponds to a scratch portion formed when the water-cooled hole 42 is formed by drilling, electric discharge machining, etc.

Next, for example, the robot arm pulls out the eddy current sensor 46, and withdraws the eddy current sensor 46 to the outside of the water-cooled hole 42. When it is determined in the determination step of S20 that there is the tool mark, for example, the robot arm inserts the nozzle 32 illustrated in FIG. 3B into the water-cooled hole 42. Further, the control unit 36 injects (shot processes) the projection material together with the compressive air from the distal end of the nozzle 32 toward the tool mark 44 on the surface of the water-cooled hole 42 of the mold 40. The shot process is performed in a third shot condition in which the tool mark 44 is removed from the surface of the water-cooled hole 42 (S22, a third shot step).

Further, a reflection member (not-illustrated zig) for reflecting the projection material is mounted to the distal end of the nozzle 32 such that the injection direction of the projection material intersects an axial direction of the nozzle 32. A lateral surface of the water-cooled hole 42 can be easily processed as such a reflection member is mounted.

The third shot step of S22 and the determination step of S20 are alternately performed until it is determined in the determination step of S20 that there is no tool mark. In this way, as the shot process (blast) is performed until there is no tool mark, the tool mark 44 is removed, so that a stress concentration to the tool mark 44 is prevented.

To supplement, since the mold 40 is repeatedly heated and cooled as described above, the mold 40 repeatedly receives a thermal stress (tensile stress f) by a thermal gradient at the time of heating and cooling, so that when there is the tool mark 44 on the surface thereof, a portion where the tool mark 44 exists becomes a stress concentration portion. However, in the present embodiment, the stress concentration portion can be removed by removing the tool mark 44.

As described above, in accordance with the shot processing method according to the present embodiment, a crack (fissure) is prevented or restrained from being generated on the surface of the water-cooled hole 42.

Supplementation Description of Embodiment

Further, although the determination step and the shot step are alternately performed in the present embodiment, the shot processing method is performed in which each of the determination step and the shot step can be performed one time.

Further, as a modified example of the first embodiment, there is a shot processing method, in which, for example, when it is determined in the determination step that there is the nitrided layer, in an initial shot step, a compressive residual stress, equal to or larger than a half of that of a case where the surface of the water-cooled hole is shot-peened to a state of being anticipated as a limitation which can maintain a state where there is the nitrided layer, is applied, and in shot step after the second time, a compressive residual stress, equal to or lower than a half of that of a case where the surface of the water-cooled hole is shot-peened to a state of being anticipated as a limitation which can maintain a state where there is the nitrided layer, is applied.

Further, as a modified example of the first embodiment, when it is determined in the initial determination step that there is the compound layer and there is the diffusion layer, the determination step and the shot step may be alternately performed until an anticipation step in which it is determined that there is no compound layer and there is the diffusion layer.

Further, although it is determined in the first embodiment whether there is the nitrided layer, there is the compound layer, and there is the diffusion layer, on the surface of the water-cooled hole 42 illustrated in FIG. 3A, by using the eddy current sensor 46 inserted into the water-cooled hole 42, it may be determined whether there is the nitrided layer, there is the compound layer, and there is the diffusion layer, on the surface of the water-cooled hole, by using, for example, other sensors such as an ultrasonic sensor, a Rayleigh wave sensor, etc. which are inserted into the water-cooled hole Meanwhile, a shot processing method, in which it is not determined whether there is the compound layer and there is the diffusion layer, on the surface of the water-cooled hole 42, may be performed.

Further, as a modified example of the embodiment, for example, when a water-cooled hole of which the diameter is thick and the depth is shallow, etc. is shot peened, the shot step may be performed while the nozzle is not inserted into the water-cooled hole.

Further, as a modified example of the second embodiment, in the determination step, it may be determined whether there is the tool mark 44 on the surface of the water-cooled hole 42 of the mold 40 illustrated in FIG. 6, by using an endoscope.

Further, the embodiment and the aforementioned plurality of modified examples can be properly combined to be implemented.

REFERENCE SIGNS LIST

| | |
|---|---|
| 14: Projection material | 32: Nozzle |
| 40: Mold | 42: Water-cooled hole |
| 44: Tool mark | 46: Eddy current sensor |

The invention claimed is:

1. A shot processing method comprising:

determining in a first determination step that there is a nitrided layer on a surface of a water-cooled hole of a mold;

shot-peening to apply a compressive residual stress to the surface of the water-cooled hole under a shot condition which maintains a state where there is the nitrided layer when it is determined in the first determination step that there is the nitrided layer; and performing a second determination step of determining whether there is a nitrided layer on the surface of the water-cooled hole of the mold after shot-peening, wherein the shot peening step is applied to a degree less than or equal to half of what would be required to remove the nitrided layer, and the second determination step and the shot step are alternately performed a plurality of times.

2. The shot processing method according to claim 1, wherein the first and second determination steps comprise a step of determining whether there is a compound layer constituting a surface side as a part of the nitrided layer, and whether there is a diffusion layer constituting a base material side as a part of the nitrided layer, and when it is determined in the first determination step that there is the compound layer and there is the diffusion layer, the second determination step and the shot step are alternately performed until it is at least determined in the second determination step that there is no compound layer and there is the diffusion layer.

3. The shot processing method according to claim 2, wherein the first and second determination step comprise a step of determining whether there is the nitrided layer on the surface of the water-cooled hole, by using an eddy current sensor inserted into the water-cooled hole.

4. The shot processing method according to claim 2, wherein the first and second determination step comprise a step of determining whether there is the compound layer constituting the surface side as a part of the nitrided layer and whether there is the diffusion layer constituting the base material side as a part of the nitrided layer, by using an eddy current sensor inserted into the water-cooled hole.

5. The shot processing method according to claim 2, wherein the shot step comprises a step of shot-peening the surface of the water-cooled hole by injecting compressed air and a projection material from a nozzle for the shot-peening, inserted into the water-cooled hole.

6. The shot processing method according to claim 1, wherein the first and second determination step comprise a step of determining whether there is the nitrided layer on the surface of the water-cooled hole, by using an eddy current sensor inserted into the water-cooled hole.

7. The shot processing method according to claim 1, wherein the shot step comprises a step of shot-peening the surface of the water-cooled hole by injecting compressed air and a projection material from a nozzle for the shot-peening, inserted into the water-cooled hole.

* * * * *